United States Patent [19]

Teague

[11] 4,366,586

[45] Jan. 4, 1983

[54] OTTOMAN ROLL LATCH MECHANISM

[75] Inventor: W. Dorwin Teague, Nyack, N.Y.

[73] Assignee: Castro Convertible Corporation, New Hyde Park, N.Y.

[21] Appl. No.: 275,778

[22] Filed: Jun. 22, 1981

[51] Int. Cl.[3] ..... A47C 17/04

[52] U.S. Cl. ..... 5/28; 5/63; 5/174; 248/151; 248/545

[58] Field of Search ..... 5/174, 175, 60, 63, 5/28–36, 44 R, 44 B; 108/113; 248/545, 151

[56] References Cited

U.S. PATENT DOCUMENTS

| | | | |
|---|---|---|---|
| 2,830,304 | 4/1958 | Ericsson | 5/63 |
| 3,050,745 | 8/1962 | Tabbert | 5/63 |
| 3,121,237 | 2/1964 | Brindisi | 5/36 |

FOREIGN PATENT DOCUMENTS

| | | | |
|---|---|---|---|
| 109610 | 11/1943 | Sweden | 5/60 |
| 156260 | 7/1956 | Sweden | 5/63 |
| 156655 | 10/1956 | Sweden | 5/63 |

*Primary Examiner*—Roy D. Frazier
*Assistant Examiner*—Michael F. Trettel
*Attorney, Agent, or Firm*—Arthur V. Smith; Pasquale A. Razzano

[57] ABSTRACT

A folding bed mechanism, such as, for example, a convertible ottoman, has a plurality of pivotally connected bed sections, including a base section supported on rollers or the like. The bed sections are adapted to unfold into a straight line and to fold into a compact configuration. The improvement of the present invention comprises at least one anti-roll foot mounted in the base section for movement toward and away from the surface on which the base section is supported and a control mechanism responsive to the initiation of unfolding pivotal movement of one of the bed sections relative to the base section for urging the foot into contact with the support surface to resist rolling of the base frame during unfolding of the bed sections.

11 Claims, 3 Drawing Figures

OTTOMAN ROLL LATCH MECHANISM

The present invention relates to convertible furniture, and in particular, to a mechanism for preventing rolling of convertible furniture during opening and closing operations.

Numerous different types of convertible furniture have been proposed in the past, in which a plurality of frame sections are foldable relative to each other so that the sections can be opened into a generally straight line configuration to provide a bed. Many of these previously proposed convertible furniture devices such as, for example, ottomans, are mounted on rollers, so that they may be easily moved from one location to another within a home. While the roller mechanisms are desirable to facilitate movement of the furniture, when the furniture is folded and unfolded, the rollers create a degree of instability in the furniture due to the varying forces applied thereto during the opening and closing operations. Thus, with typical ottomans mounted on rollers, the ottomans will travel and move undesirably during the folding and unfolding operations.

While most convertible furniture will, in its extended position, have legs or other supports that do not include rollers which will engage the support surface when the furniture is opened to its fully extended position, such legs or supports do not prevent movement of the furniture during opening and closing operations. Some prior art devices, such as, for example, as shown in U.S. Pat. No. 3,128,123 and British Pat. No. 496,188 discloses convertible furniture in which such support legs or elements are engaged with the support surface at some stage during the folding and unfolding operations. However, in each case, the unrollered support engages the ground at a period of time relatively long after the initial opening operation commences. Thus, there is a substantial period of time during the opening and closing operation that the bed can travel on its roller supports.

It is an object of the present invention to provide a roll latch mechanism which will prevent rolling of a convertible piece of furniture during substantially all portions of the opening and closing operations.

Another object of the present invention is to provide an anti-rolling mechanism for convertible furniture which is responsive to the initial opening of the furniture.

A still further object of the present invention is to provide an anti-roll latching device for convertible furniture which is relatively simple in construction.

In accordance with an aspect of the present invention, a convertible bed mechanism is provided that has a plurality of serially and pivotally interconnected bed sections, one of which defines a base section supported on rollers. The various bed sections are adapted to be folded into a compact, superimposed configuration with one of the sections defining an upper section in the folded configuration of the mechanism. The sections are also adapted to be unfolded into a straight line configuration to form the bed.

In accordance with a specific feature of the present invention, an anti-roll latch means is provided for preventing rolling of the mechanism on the surface on which it is supported during folding and unfolding of the bed sections. The anti-roll latch means includes a bell crank pivotally mounted between its ends on the base section for movement between a first roll latching position and a second, unlatching position. A latch foot is pivotally connected at one end to one end of the bell crank and has an opposite end located adjacent the support surface. Cooperating means on the upper bed section and the other end of the bell crank are provided for pivoting the bell crank from its unlatched position towards its latched position upon initial unfolding pivotal movement of the upper bed section. As a result of this pivoting movement, the latch foot is brought into contact with the support surface, to resist rolling movement of the bed frame on the support surface.

The above, and other objects, features and advantages of this invention will be apparent in the following detailed description of an illustrative embodiment of the invention, when read in connection with the accompanying drawings, wherein.

Figure 1:
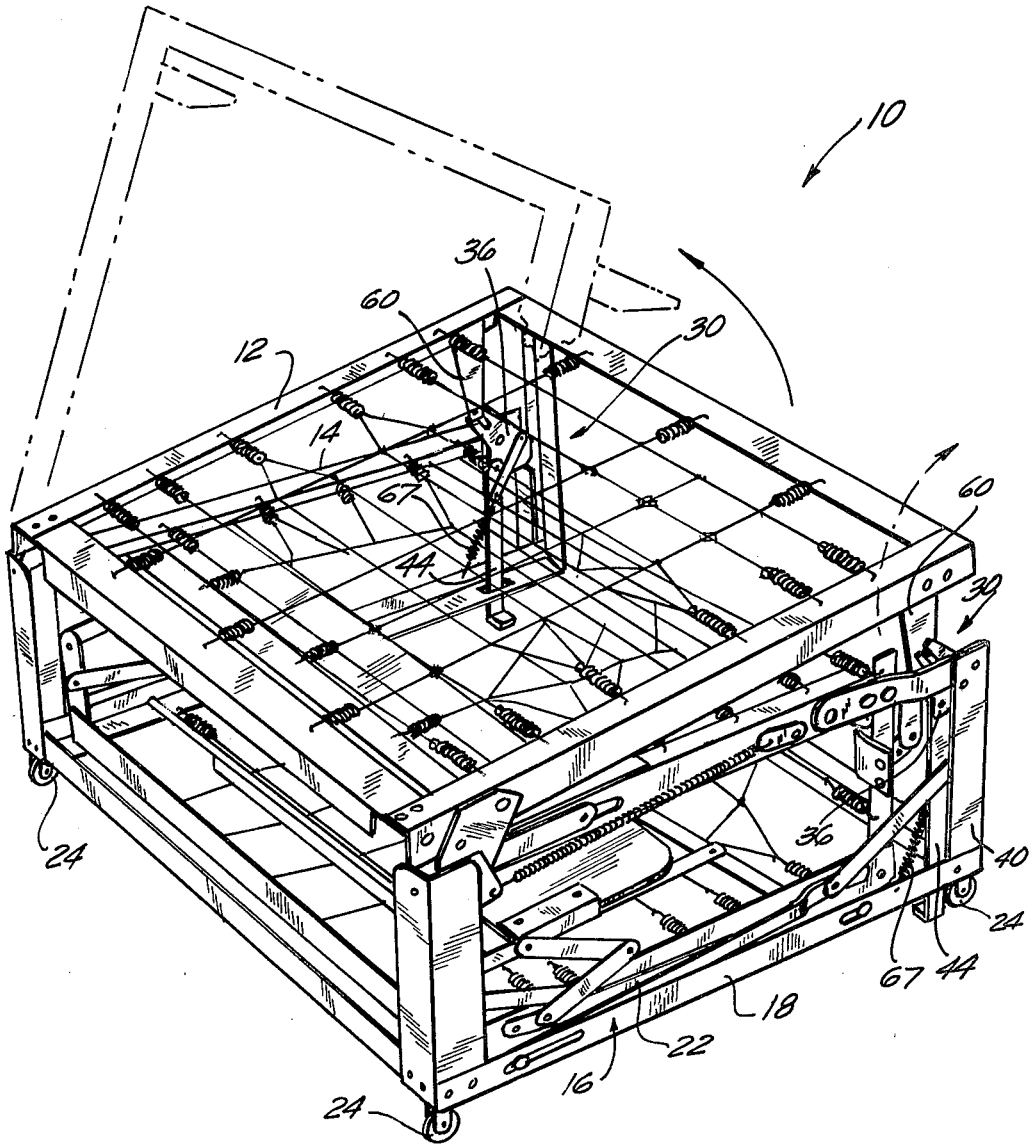
FIG. 1 is a perspective view of a bed mechanism including an anti-roll latch device constructed in accordance with the present invention.

Referring now to the drawing in detail, and initially to FIG. 1 thereof, a convertible bed mechanism, such as, for example, a convertible ottoman is illustrated. The particular ottoman as illustrated is of conventional commercially available construction, and in particular, is of the type sold by Castro Convertible Corporation of New Hyde Park, N.Y. This mechanism for the ottoman consists of three sections 12, 14 and 16 mounted on a base frame 18. Sections 12–16 are pivotally connected to each other in a known manner so that the sections can be unfolded into a straight line configuration. In the folded configuration seen in FIG. 1, section 12 forms the upper frame section and, in the unfolded configuration, it forms the foot of the bed. Section 16 remains on base frame 18 in the unfolded configuration and forms the head of the bed. This section includes a headboard 22 in the known manner.

Frame 18 of mechanism 10 is supported on wheels 24, such as conventional rollers or casters which enable the bed frame mechanism to be moved about easily when it is in the folded configuration. It will be understood that in the illustrative embodiment of the invention, the mattress for the bed has been removed, for convenience of illustration. However, in actual use, a z-fold mattress would be mounted on bed sections 12, 14, 16 in a known manner.

Because frame 18 is mounted on rollers, during the unfolding operation with the conventional commercially available mechanism, it is possible for frame 18 to travel on the support surface, particularly, where the support surface is smooth. Such travel is undesirable and makes it more difficult to open and close the mechanism.

In accordance with the present invention, bed mechanism 10 includes an anti-roll latch device 30 located at two corners of frame 18, adjacent the side towards which the frame opens. This anti-roll latch mechanism is shown in greater detail in FIGS. 2 and 3.

Figure 2:
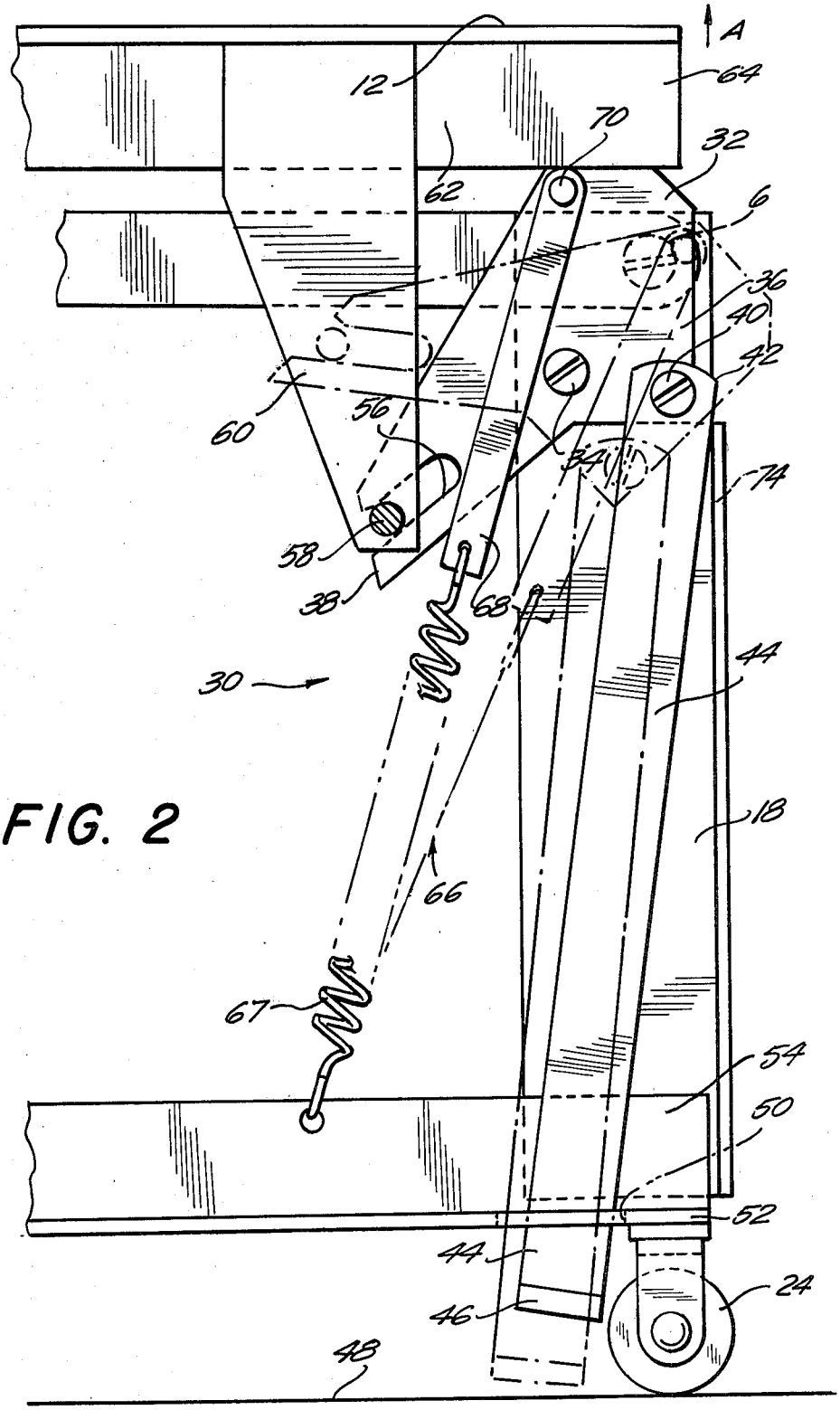
FIG. 2 is an enlarged side sectional view showing the anti-roll latch mechanism in its unlatched position, in solid lines.

As seen in FIG. 2, mechanism 30 includes a bell crank element 32 pivotally mounted on base section or frame 18 by a pivot pin or bolt 34. The bell crank has opposite ends 36, 38 respectively. End 38 of the bell crank is pivotally connected by a bolt 40 to upper end 42 of latching foot 44. Opposite end 46 of foot 44 is L-shaped, and located adjacent support surface 48 on which the bed frame is supported by wheels 24. Foot 44 extends through a slot 50 in flange 52 of frame angle 54. The foot is movable with crank 32, upon pivotal movement thereof from its unlatching position showing in FIG. 2 wherein end 46 is spaced from surface 48 to its latching position wherein end 46 is engaged with surface 48.

The end 38 of crank 32 has an open ended slot 56 formed therein. This slot receives a pin 58 secured to a bracket 60 mounted on the side frame element 62 of upper section 12. In the unlatching position of mechanism 30, pin 58 is received in the outer end of slot 56, as seen in FIG. 2.

When it is desired to open of unfold the bed mechanism, bed section 12 is fitted at its front end 64 and moved upwardly in the direction of the arrow A, shown in FIG. 2. This upward movement of bed section 12, causes crank element 32 to pivot on pin 34 in a clockwise direction, as illustrated in FIG. 2. This clockwise movement, indicated in dotted lines in FIG. 2, drives foot 44 downwardly, towards support surface 48.

To aid in the pivotal movement of crank 32, and to maintain foot 44 in its latching position, an over the center spring mechanism 66 is provided. This mechanism includes spring 67, which is connected at one end to frame element 54 and at its other end to a link 68. Link 68 is in turn pivotally at 70 to bell crank 32.

In the unlatching position illustrated in FIG. 2, link 68 is located to the left of pin 34 so that spring 67 biases crank 32 in a counterclockwise direction towards its unlatching position. Pivotal movement of the crank beyond this latching position under the influence of spring 67 is prevented by the engagement of pin 58 in slot 56.

As crank 32 is pivoted in a clockwise direction due to opening or unfolding movement of bed section 12, as described above, the alignment of link 68 will pass "over the center" of pivot pin 34, so that spring 67 thereby now will bias the crank in a clockwise direction towards its latching position. Only a slight movement of bed section 12 in the direction of arrow A is necessary to move link 68 over the center and thus drive foot 44 into the latching position shown in FIG. 3.

Continued unfolding movement of bed section 12 will cause pin 58 to disengage from slot 56 as bed section 12 moves further away from frame 18. When this disengagement occurs, link 68 will have already passed over center, so that spring 67 will continue to urge crank 32 in a clockwise direction into its full latching position shown in FIG. 3. This position is limited by the engagement of edge 72 of crank 32 against upper end 74 of flange 76 on forward frame element 78 of base 18. In this position foot 46 engages support surface 48 and prevents rolling movement of the bed on that support surface.

When the bed mechanism is refolded to its folded and compact configuration, leg 46 will remain in its latching anti-roll position during substantially the entire operation. It will be released to return to its unlatching position only when pin 58 approaches and enters slot 56 as bed section 12 returns towards its fully folded position. This is indicated by dotted line pin 58 in FIG. 3. Further downward movement of bed section 12 after pin 58 enters slot 56 will urge crank 32 in a counterclockwise direction against the bias of spring 67, until link 68 again passes "over center". When that occurs, the spring will take over movement of crank 32 and return it to its full unlatching position illustrated in FIG. 2. In this position, foot 46 is spaced away from support surface 48 so that the bed mechanism is free to roll.

Figures 3, 4:
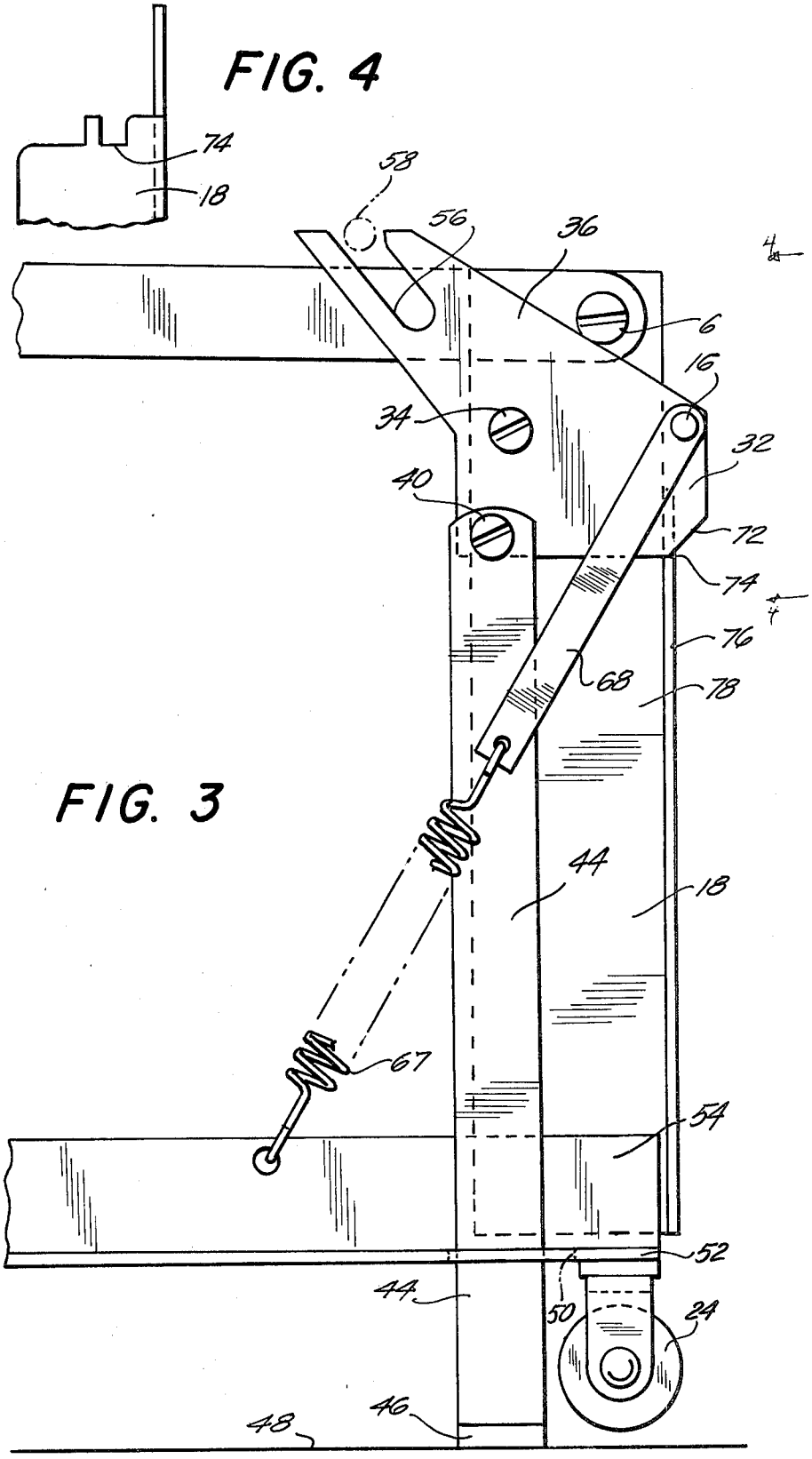
FIG. 3 is a side sectional view, similar to FIG. 1, showing the anti-roll latch mechanism in its latching position.
FIG. 4 is a partial end view along line 4—4 of FIG. 3.

Although only a single mechanism 30 has been described with reference to FIGS. 2 and 3, as seen in FIG. 1, a mechanism 30 is located at each of the front corners of the bed frame. These mechanisms are of identical construction and thus, only one has been described in detail. It will be appreciated that the anti-roll latch mechanisms, operating at opposite corners of the bed frame, will provide a secure and positive resistance to rolling of the bed frame during the opening and closing operations.

Although an illustrative embodiment of the present invention has been described herein with reference to the accompanying drawings it is to be understood that the invention is not limited to that precise embodiment, and that various other changes and modifications may be effected therein by one skilled in the art without departing from the scope or spirit of this invention.

What is claimed is:

1. In a bed mechanism having a plurality of pivotally connected bed sections, including a base section supported on rollers or the like with said section being adapted to unfold into a straight line and fold into a compact configuration, the improvement comprising at least one anti-roll foot mounted in said base section for movement towards and away from the surface on which the base section is supported and means responsive to the initiation of unfolding pivotal movement of one of said bed sections relative to said base section for urging said foot into contact with said support surface to resist rolling of said base frame during unfolding of said bed sections.

2. In a bed mechanism as defined in claim 1 wherein said means includes a crank element pivotally mounted on said base section for movement between a first roll latching position and a second, unlatching position and also being pivotally connected to said foot.

3. In a bed mechanism as defined in claim 2 wherein said means includes cooperating means on said one bed section and crank for pivoting said crank from said unlatching position towards said latching position when unfolding of the bed sections is initiated and for pivoting said crank from said latching position towards said unlatching position when folding of the bed sections is substantially complete.

4. In a bed mechanism as defined in claim 3 including spring means operatively connected between said base section and said crank in "over the center" relation to the pivotal connection of the crank to the base section to urge said crank to its latching position when said bed sections are unfolded and to its unlatching position when they are folded.

5. In a bed mechanism as defined in any one of claims 3 or 4 wherein said cooperating means comprises a pin mounted on said one bed section and an open ended slot formed in one end of said crank for receiving said pin.

6. In a bed mechanism as defined in claim 1, means on said base section for guiding movement of said foot.

7. In a bed mechanism having plurality of serially and pivotally interconnected bed sections, one of which defines a base section supported on rollers, adapted to be folded into a compact generally superimposed configuration with one of said sections defining an upper section in the folded configuration and unfolded into a straight line, the improvement comprising anti-roll latch means for preventing rolling of the mechanism on the surface on which it is supported during folding and unfolding of said bed sections, said means including a bell crank pivotally mounted between its ends on said base section for movement between a first roll latching position and a second unlatching position, a latch foot pivotally connected at one end to one end of the crank and having an opposite end adjacent said support surface; and cooperating means on said upper bed section and the other end of said bell crank for pivoting said bell crank from its unlatching position towards said latching position upon initial unfolding pivotal movement of said upper bed section thereby to move said latch foot into contact with said support surface.

8. In a bed mechanism as defined in claim 7 wherein said cooperating means are positioned to pivot said crank from its latched to its unlatched position as said one bed section approaches its fully folded position, thereby to raise said foot away from said support surface.

9. In a bed mechanism as defined in claim 8 including spring means operatively connected between said base section and said crank in "over the center" relation to the pivotal connection of the crank to the base section to urge said crank to its latching position when said bed sections are unfolded and to its unlatching position when they are folded.

10. In a bed mechanism as defined in claim 9 wherein said cooperating means comprises a pin mounted on said one bed section and an open ended slot formed in one end of said crank for receiving said pin.

11. In a bed mechanism as defined in claim 10, means on said base section for guiding movement of said foot.

* * * * *